United States Patent [19]

Becker et al.

[11] Patent Number: 4,872,409

[45] Date of Patent: Oct. 10, 1989

[54] KINETIC-ENERGY PROJECTILE HAVING A LARGE LENGTH TO DIAMETER RATIO

[75] Inventors: Wilfried Becker, Duesseldorf; Bernhard Bisping, Ratingen, both of Fed. Rep. of Germany

[73] Assignee: Rheinmetall GmbH, Duesseldorf, Fed. Rep. of Germany

[21] Appl. No.: 185,240

[22] Filed: Aug. 17, 1987

Related U.S. Application Data

[63] Continuation of Ser. No. 826,554, Feb. 6, 1986, abandoned, which is a continuation-in-part of Ser. No. 552,271, Nov. 16, 1983, abandoned.

[30] Foreign Application Priority Data

Nov. 18, 1982 [DE] Fed. Rep. of Germany ..... 3242591

[51] Int. Cl.[4] ..... F42B 13/16

[52] U.S. Cl. ..... 102/517; 102/501

[58] Field of Search ..... 102/517-523, 102/501, 703

[56] References Cited

U.S. PATENT DOCUMENTS

| | | | |
|---|---|---|---|
| 2,393,648 | 6/1946 | Martin . | |
| 3,888,636 | 6/1975 | Sczerzenie et al. | 102/501 |
| 3,979,234 | 9/1976 | Northcutt, Jr. et al. . | |
| 4,108,072 | 8/1978 | Trinks et al. | 102/518 |
| 4,353,305 | 10/1982 | Moreau et al. | 102/519 |
| 4,638,738 | 1/1987 | Bisping et al. | 102/517 |
| 4,671,180 | 6/1987 | Wallow et al. | 102/517 |

FOREIGN PATENT DOCUMENTS

| | | |
|---|---|---|
| 51375 | 5/1982 | European Pat. Off. . |
| 73385 | 3/1983 | European Pat. Off. . |
| 579205 | 7/1946 | United Kingdom . |
| 1095992 | 12/1967 | United Kingdom . |

*Primary Examiner*—Harold J. Tudor
*Attorney, Agent, or Firm*—Klein & Vibber

[57] ABSTRACT

A sub-caliber projectile having a large length to diameter ratio. The projectile includes in coaxial alignment a main body, an intermediate body and a head penetrator. At least the main body consists of a tough material having a high density which is achieved by means of a high content of tungsten or depleted uranium. The intermediate body consists of a macroscopic homogeneous material having a relatively high brittleness. The main body, intermediate body and head penetrator have abutting end faces by means of which they are joined.

5 Claims, 2 Drawing Sheets

KINETIC-ENERGY PROJECTILE HAVING A LARGE LENGTH TO DIAMETER RATIO

CROSS-REFERENCE TO RELATED APPLICATION

This is a continuation of application, Ser. No. 826,554, filed Feb. 6, 1986 now abandoned which in turn is a continuation in part of Ser. No. 552,271, filed Nov. 16, 1983, now abandoned.

BACKGROUND OF THE INVENTION

Kinetic-energy projectiles are known and described in U.S. Pat. No. 4,343,305. The intermediate body of such projectiles are in the form of an envelope which surrounds and encloses a large quantity of sub-projectiles. Alternately these sub-projectiles may be embedded in a sintered metal powder material or in a binder. Upon impacting on an armored target the piercing head impacts on the first plate of the target by piercing it or indenting it.

If the target is in the form of a single armor plate then the sub-projectiles scatter behind the target plate in the shape of a cone and thereby have a destructive effect over as large as possible a space of the target area. For a better distribution of the sub-projectiles, those surfaces of the main penetrator which confront the piercing head, are conically shaped. Moreover, in the central region of the envelope forming the intermediate body or so-called "spacing means" there can be disposed an explosive charge for increasing the scatter energy of the sub-projectiles. When this state of the art projectile is to be used against a multi-plated armored target then the sub-projectiles jointly with fragments from the first (outer) target plate and the subsequently following main penetrator must become effective against a second (interior) target plate.

The drawbacks of this state of the art kinetic-energy projectile reside in its construction, which is quite complex and costly to manufacture; the preshaped sub-projectiles negatively influence the density of the intermediate body (also referred to as the "spacing means") and, in the event spheres are used, then the interstitial spaces between the spheres remain largely unused; the explosive charge inhibits the density of the intermediate body per se and requires a primer or ignition fuse, which does not only complicate the construction but also inhibits additionally the density of the assembly; the preformed sub-projectiles lead to a poor energy balance at the target of this known kinetic energy projectile and reduce the adaptability of the projectiles towards different prevailing conditions on the target.

The invention relates to an improved inertial-kinetic-energy penetrator projectile. The projectile of the invention is of the fin-stabilized type. Spin-stabilized projectiles using similar high-density materials are, for example, disclosed in European patent applications Nos. 51 375 and 73 385 as well as U.S. Pat. No. 2,393,648 and British patent No. 579 205. These publications describe short inertial spin-stabilized penetrator projectiles, which are suitable only for penetrating aluminum armor of air planes or penetrate thin steel armor. In these known projectiles the middle portion forms the main portion of the projectile which is to be decomposed immediately after the penetration of the nose into the armor. The tail portion, which is weakened by recesses for receiving additional parts of the projectile, can no longer have a significant penetrating effect, in particular in view of the fact that when such projectile is used against armor plating it becomes inclined upon impact relative to the armor plating causing deviation of the tail portion relative to the desired direction.

PRIOR ART

The short projectiles in accordance with European patent Nos. 73 385 and 0051375, which must be considered in conjunction with the related European patent application No. 73 384, have the main portion of the projectile always disposed in their middle region, which disintegrates immediately after the penetration of the nose into the armored plating so that the tail portion can no longer have any significant effect on the steel armored plating. The projectile of European application No. 51375 is only designed for penetrating aluminum sheathing of air planes. In such projectiles the main penetrating effect is already exhausted in the pre-armored plate. Such a projectile is not designed for use on steel armored plating.

SUMMARY OF THE INVENTION

It is an object of this invention to provide a kinetic-energy projectile of the afore-described type that is of simple construction and more inexpensive to produce, when compared to the afore-described projectiles of the state of the art. It is an object of this invention to provide an inertial penetrator projectile, which is capable to penetrate multi-plated targets in which several plates of the armor are spaced from each other. A deviational reflection is avoided with the penetrator of this invention until it has reached the rearmost armored plate. The kinetic-energy projectile of the invention has as high a density as possible, has a good energy balance at the target, and is adaptable to a wide range of conditions prevailing at the target. An object of this inertial projectile is to penetrate a plurality of armored plates spaced from each other whereby a deflection of the projectile portions is avoided up to the last, respectively the rearmost armored plating. The kinetic-energy penetrator of the invention produces advantageously a scatter cone having a larger point angle. Additionally, a substantial portion of the impact energy is transformed into heat, which is extensively transferred onto the particles forming the material for the intermediate body and thereby leads to an additional combustion effect of these particles. A dense cloud of a large number of particles is formed of favorable size distribution and thereby no breakdown of the main penetrator results at the outer plate upon impact on a multi-plate target.

A further advantage is achieved as a result of the simplicity of construction, which in practice makes it possible to manufacture the penetrator of the invention at a substantially reduced cost.

BRIEF DESCRIPTION OF THE DRAWING

The invention will be better understood when read in conjunction with the description of two illustrative embodiments of a penetrator of the invention.

The drawings forming part of this description specify or illustrate schematically three modes of implementation of the invention.

DETAILED DESCRIPTION

Figure 1:
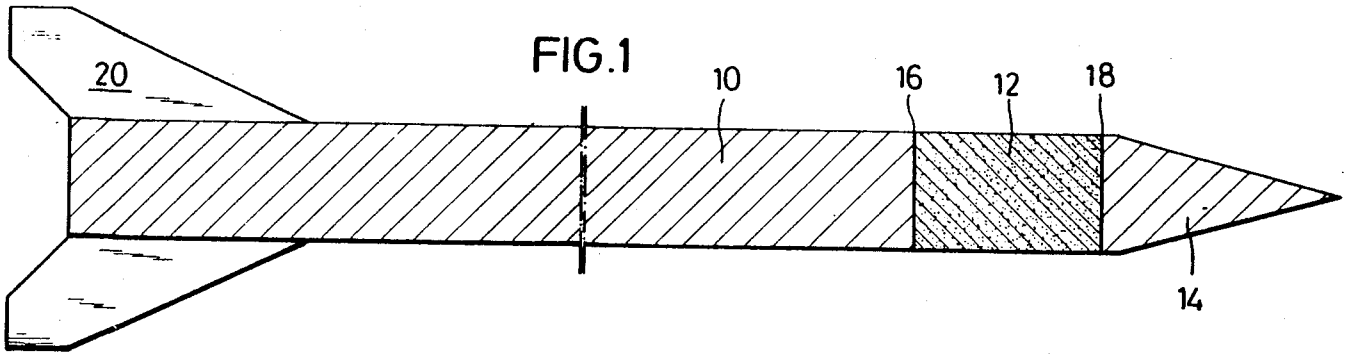
FIG. 1 illustrates a first embodiment of a kinetic-energy penetrator of the invention which is shown in elevational cross-section.

FIG. 1 illustrates a penetrator. The length to diameter ratio L/D in a spin-stabilized projectile having a large length to diameter ratio is about 4 to 5, whereas in a fin-stabilized penetrator, as disclosed in FIGS. 1 and 2, this ratio L/D is at least 8.3 and can be as high as 20. The constructional details of the penetrator have not been described and illustrated in detail. It includes a main body 10, an intermediate body 12 and a nose penetrator body in the shape of a cone 14. The main body 10 is joined in a plane butt-impact region 16 to the intermediate body 12, for example by means of diffusion sintering or hard-welding. A corresponding joint between the intermediate body 12 and the nose penetrator 14 consists in a plane butt impact region 18. At its tail the main body 10 is provided with stabilization wings 20 which form guide means for the penetrator assembly. The main body 10 and the nose penetrator 14 are made out of a tough ductile material, the high density of which is achieved by means of a high content of tungsten or depleted uranium and contains also nickel and iron (such as, for example, disclosed in U.S. Pat. Nos. 3,979,234 and 3,888,636). The main body has 50% to 70% of the total length of the penetrator. The intermediate body 12 consists of a macroscopic homogeneous material (macroscopic homogeneous material means a material in which only one phase is visible when viewed with the naked eye) preferably made out of a brittle sintered alloy having a high tungsten and/or depleted uranium content and as low as possible a content of a binding medium phase. When depleted uranium is used for achieving the desired effect of the intermediate body 12, high density sintered particles, consisting of uranium powder, are soaked with as low an amount of a metal or metal alloy as possible, the melting temperature (s) of which lies below that of uranium. It is possible to advantageously achieve a sufficient strength and ruggedness of the intermediate body 12 and a particularly high brittleness in the region of the intermediate body 12 which has not been soaked as described hereinabove, by using tungsten as well as uranium, by soaking the intermediate body 12 with a corresponding binding medium phase in a predetermined radial range in the peripheral region. This suitable binder forms a macroscopic homogeneous material. The intermediate body 12 has preferably a length to diameter ratio of about 1.5.

Figure 2:
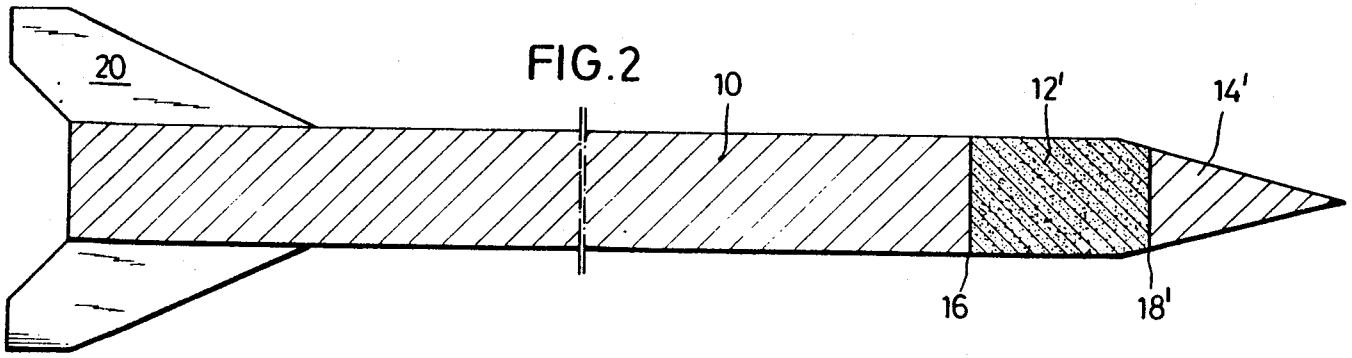
FIG. 2 illustrates a second embodiment of the kinetic-energy penetrator of the invention also shown in cross-sectional elevation.

The embodiment of FIG. 2 differentiates itself from that of FIG. 1 by means of a different design of the intermediate body 12' and the head penetrator 14', which are again joined by means of a plane butt impact region 18' in the previously described manner.

When the penetrator of the invention impacts on a target the particles which are formed from the intermediate body 12, 12' spread out to form the firing channel and achieve, behind a first target plate, a strong blast effect. It has been observed that at impact the particles which are formed by the material of the intermediate body 12, 12' are more effective as preshaped scatter projectiles. This effect is increased as a result of the fact that heat produced at target impact shock is extensively transferred onto the particles, so that there is engendered in them an additional combustion effect. This combustion effect is particularly high when uranium is used which has pyrophoric properties. A further advantage results from the fact that the particles formed from the material of the intermediate body 12, 12' are of reduced size; they do not form a blocking or deflecting obstacle for the main body 10 which penetrates further into the target upon impact on a multi-plate target. In the embodiment of FIG. 2 the comparatively reduced diameter of the butt impact region 18' renders advantageously the possibility that a peripheral region of the intermediate body 12' does already move forwardly at the butt impact region 18' in the firing direction at initial impact so that the expansion effect of the particles of raw material on the firing channel is intensified. Summarizing, the penetrator of the invention provide a particularly favorable energy balance at the target. Thereby, in contradistinction to the preformed scatter projectiles, there is achieved advantageously a better adaptation to the conditions prevailing at the target, for example, conditions such as a strongly sloping target.

When using the penetrator of the invention against multiplate targets with, e.g. those made out of several steel plates and those ones where steel plates are combined with ceramic and/or glass moduli, there is formed, by means of the particles from the intermediate body 12, 12', a large and deep impact hole in the sheathing of the related target. If glass and/or ceramic moduli are present fragments out of said materials can escape through said hole and thereby reduce substantially the hinderance-characteristics of said moduli for the subsequently following main body 10. Therefrom results a substantial improvement of penetration. As can be seen from FIG. 3, a practical application of this type of penetrator causes an impact on the to be penetrated armor plating at a certain angle. First the projectile nose penetrates into the first armored plating which is followed by a splintering of the projectile body by compressing of the rear portion of the projectile body causing an inclination so that the projectile breaks up laterally in a direction of the thinner wall thickness, i.e. it is deflected.

Figure 3:
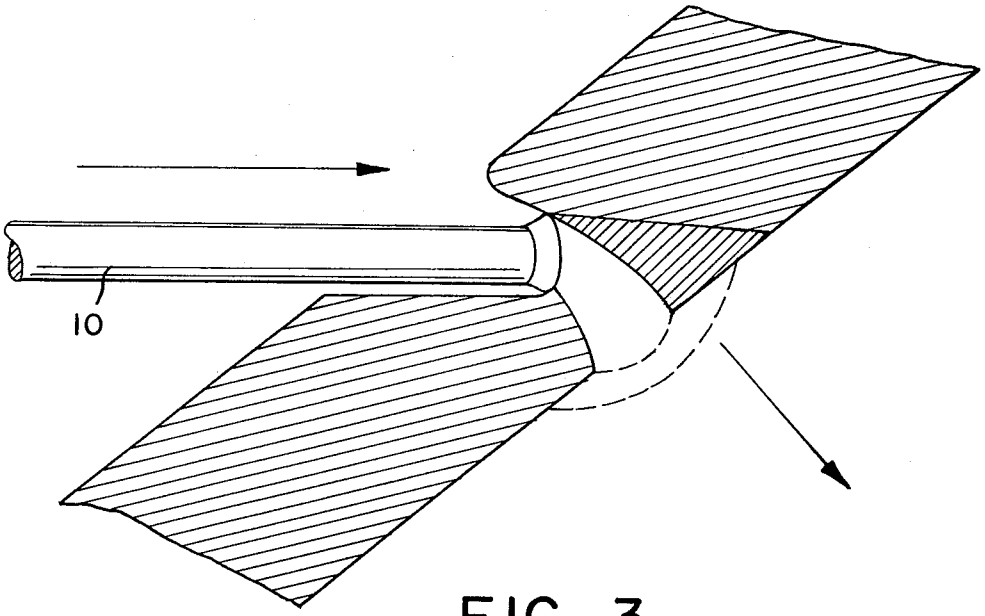
FIG. 3 is a schematic view showing in cross-section the impact effect of a penetrator on an armor-plated target.

As can be seen from FIG. 3 there remains, as is shown in cross-hatching, a material rest which can no longer be removed by the following penetrator portions of reduced mass.

The instant invention improves upon this penetration characteristic by making the middle portion of the penetrator of brittle material, which decomposes into fine powdery particles, so that the next following main portion of large mass is not hindered into its penetration by these powdery particles. In addition thereto the splintered middle portion expands the penetration holes so that they become larger than the caliber of the penetrator thereby permitting the heretofore undamaged main portion of the penetrator to penetrate in unhinderd fashion and with its sharp edges to remove the remanent cross-hatched rest and to penetrate into the main armor.

Although the invention is described and illustrated with reference to a plurality of embodiments thereof, it is to be expressly understood that it is in no way limited to the disclosure of such preferred embodiments but is capable of numerous modifications within the scope of the appended claims.

We claim:

1. A fin stabilized arrow-shaped subcaliber penetrator having a large length to diameter ratio of uniform cross section substantially over its entire length and having a high initial muzzle exit velocity and high kinetic energy to be fired with a sabot out of a large caliber weapon, comprising in combination, a main body, an intermediate body and a front conically shaped nose body in coaxial alignment with each other; the length of said intermediate body is about 1.5 times as large as its maximum diameter;

said main body comprising between 50% and 70% of the total length of said penetrator;

said main body and said nose penetrator consisting of a tough metal alloy made from the metals of tungsten or depleted uranium and nickel and iron;

said intermediate body consisting of high density brittle sintered alloy which has a high content of tungsten or depleted uranium and a low content of a binding medium;

said main body, intermediate body and nose body having abutting butt end faces by means of which they are joined to each other; whereby in use, on impact of the penetrator against a target only the intermediate body fractures into a plurality of relatively small sized particles that widen the hole formed by the nose body impacting against the target beyond the caliber size of the penetrator, thereby to make possible relatively unimpacted travel of the main body through the hole.

2. The sub-caliber penetrator as defined in claim 1, wherein said abutting butt end faces have equal diameters.

3. The sub-caliber penetrator as defined in claim 1, wherein the abutting end faces between said nose penetrator and said intermediate body have a smaller diameter than said abutting end faces between said intermediate body and said main body.

4. The sub-caliber penetrator as defined in claim 2, wherein said abutting end faces are joined to each other by means of hard welding.

5. The sub-caliber penetrator as defined in claim 2, wherein said abutting end faces are joined to each other by means of diffusion sintering.

* * * * *